US007014046B2

(12) United States Patent
Niu et al.

(10) Patent No.: US 7,014,046 B2
(45) Date of Patent: Mar. 21, 2006

(54) I-BEAM WALL CORNER POST

(75) Inventors: Xiaokai Niu, Hartsville, SC (US); Michael D. Zold, Hartsville, SC (US); Johannes Wilhelmus van de Camp, Hartsville, SC (US); Yanping Qiu, Middleton, WI (US)

(73) Assignee: Sonoco Development, Inc., Hartsville, SC (US)

( * ) Notice: Subject to any disclaimer, the term of this patent is extended or adjusted under 35 U.S.C. 154(b) by 8 days.

(21) Appl. No.: 10/604,729

(22) Filed: Aug. 13, 2003

(65) Prior Publication Data

US 2005/0035257 A1 Feb. 17, 2005

(51) Int. Cl.
*B65D 85/30* (2006.01)

(52) U.S. Cl. ..... 206/586; 206/320; 428/34.2

(58) Field of Classification Search ..... 248/345.1, 248/345; 206/586, 320, 591, 592, 326, 453; 428/34.2

See application file for complete search history.

(56) References Cited

U.S. PATENT DOCUMENTS

| | | | | |
|---|---|---|---|---|
| 3,072,313 | A * | 1/1963 | Svendsen | 206/586 |
| 3,337,111 | A * | 8/1967 | Petriekis et al. | 206/586 |
| 3,536,245 | A | 10/1970 | Palmer | |
| 3,708,101 | A * | 1/1973 | McDanield | 206/521 |
| 3,734,389 | A * | 5/1973 | Brown | 206/586 |
| 4,127,188 | A * | 11/1978 | Heaney | 206/453 |
| 4,399,915 | A | 8/1983 | Sorenson | |
| 4,482,054 | A | 11/1984 | Gardner | |
| 4,496,054 | A | 1/1985 | Koltun | |
| 4,553,363 | A | 11/1985 | Weinar | |
| 4,771,893 | A | 9/1988 | Liebel | |
| 5,131,541 | A | 7/1992 | Liebel | |
| 5,181,611 | A | 1/1993 | Liebel | |
| 5,267,651 | A | 12/1993 | Hughes | |
| 5,538,778 | A | 7/1996 | Hurwitz et al. | |
| 5,680,934 | A | 10/1997 | Jaegers et al. | |
| 5,688,578 | A | 11/1997 | Goodrich | |
| 5,799,797 | A | 9/1998 | Braun | |
| 5,813,537 | A | 9/1998 | DeReu et al. | |
| 6,186,329 | B1 | 2/2001 | Qiu | |
| 6,268,039 | B1 * | 7/2001 | Chou et al. | 428/122 |
| 6,357,587 | B1 * | 3/2002 | Melms, Jr. | 206/326 |
| 2003/0057128 | A1 * | 3/2003 | Hardy | 206/586 |
| 2003/0111383 | A1 * | 6/2003 | Qiu et al. | 206/586 |

* cited by examiner

*Primary Examiner*—Ramon O Ramirez
(74) *Attorney, Agent, or Firm*—Clausen Miller, P.C.

(57) ABSTRACT

An improved support post for cushioning and supporting large products is provided. The post is made from a sheet that is convolutely wound around a mandrel and shaped into a desired shape. The improvement comprises making the sheet from multiple thicknesses of paper so that, upon winding the sheet into a tube, the middle layer of the tube is thicker than the outer layers. The post has a higher axial compression strength than a conventional post, but the same amount (weight) of material.

20 Claims, 7 Drawing Sheets

I-BEAM WALL CORNER POST

BACKGROUND OF INVENTION

This patent relates to protective packaging for large appliances such as washers, dryers and refrigerators. More particularly, this patent relates to an improved tubular-type protective corner post or side post that has a higher axial compression strength using the same amount (weight) of material as a conventional corner post.

Tubular type corner posts are used for holding axial compressive loads and protecting the corners of goods such as washers, dryers, refrigerators, dishwashers and stoves. Conventional tubular corner posts are made of a single sheet of paper wound into a convolute tube. Adhesive is used to bond the paper layers. Before the adhesive dries, the tube is shaped into the desired shape, typically one with a modified "L" shaped cross section to fit snugly between the corner of an appliance and the corner of the appliance container.

Various corner posts are described in the literature. Commonly owned Qiu U.S. Pat. No. 6,186,329, for example, describes a corner post made of multiple sheets of paper joined end to end and then wound around a mandrel so that the post wall has a strong-weak-strong profile in the transverse direction. In other words, a relatively weaker, less expensive grade of paper is sandwiched between layers of relatively stronger, costlier paper. The overall sheet, and the post, has a uniform thickness.

The failure mode of a corner post under axial compression is buckling. Therefore, the bending stiffness of the post structure is a critical parameter. It has been found that wall thickness and the physical characteristics of the material on the outside of the corner post wall determine bending stiffness.

The object of the present invention is to increase the bending stiffness of a corner post using the same amount (weight) of material as a conventional corner post.

Further and additional objects will appear from the description, accompanying drawings, and appended claims.

SUMMARY OF INVENTION

The present invention builds on the idea of making a support post from multiple kinds of paper, but instead of using multiple kinds of paper of similar thickness as taught in the Qiu '329 patent, the present invention uses paper of different thicknesses.

The I-beam wall corner post is a support post used for cushioning and supporting large products. The post is made from a rectangular sheet that is convolutely wound around a mandrel and shaped into the desired shape. The improvement comprises making the sheet from multiple thicknesses of paper so that, upon winding the sheet into a tube, a portion or all of the middle layer of the tube is thicker than the outer layers.

Making the middle layer thicker results in a post having a higher axial compression strength using the same amount (weight) of material as a conventional corner post. The principle is similar to that of an iron or steel I-beam having an I-shaped cross-section. Due to its shape, the I-beam has a greater bending stiffness than a beam of equal weight having a solid rectangular cross-section. The principle is also similar to that of corrugated board, where the middle layer of the corrugated board is fluted to increase the thickness, and thus the stiffness, of the board.

In the present invention, the middle layer is made thicker by replacing some of the fiber ordinarily found in the middle layers of the post with air. This may be accomplished in at least three ways.

In a first embodiment, the middle layer is made from structured, or embossed, paper. Embossed paper has raised areas on its surface for a nippled effect, which effectively increases the caliper (thickness) of the paper without changing its overall weight. The embossed paper may be made by running a sheet of paper through a pair of opposing rollers to create areas on the paper that are compressed and other areas where the paper fibers have been pushed upward to create the raised areas. Alternatively, the embossed paper may be made by joining an embossed sheet end to end with one or more non-embossed sheets. In either case, the resulting rectangular sheet has alternating thicknesses in the cross machine direction. (The cross machine direction is the direction perpendicular to the axis of the finished post.)

To make an I-beam wall post, the embossed paper is convolutely wound into a multi-layer tube in which the thicker, embossed section is sandwiched between non-embossed outer layers. Before the adhesive applied between the paper layers is set, the tube is formed on a mandrel into a post having a desired cross-sectional shape.

In a second embodiment, the middle layer is made from low density paper. Low density paper has a very low density middle portion sandwiched between smooth surfaces (liners). Low density paper may be made from a mixture of recycled fiber and other low density materials to provide decreased density and increased bulk (thickness). The low density paper is joined end to end with conventional paper to form a rectangular sheet, then wound around a mandrel to form a tube having a relatively thicker middle layer sandwiched between relatively thinner outer facing layers of conventional paper. The tube is then formed into the desired post shape.

In a third embodiment, thickness in the middle layer of the post is achieved by laminating a second sheet (embossed or low-density) onto a substrate in selected areas, resulting in a combined sheet having alternating thicknesses in the cross machine direction. The combined sheet is then wound such that the thicker areas are located in the middle layer of the tube, then the tube is formed into a post.

DETAILED DESCRIPTION

Figure 1:
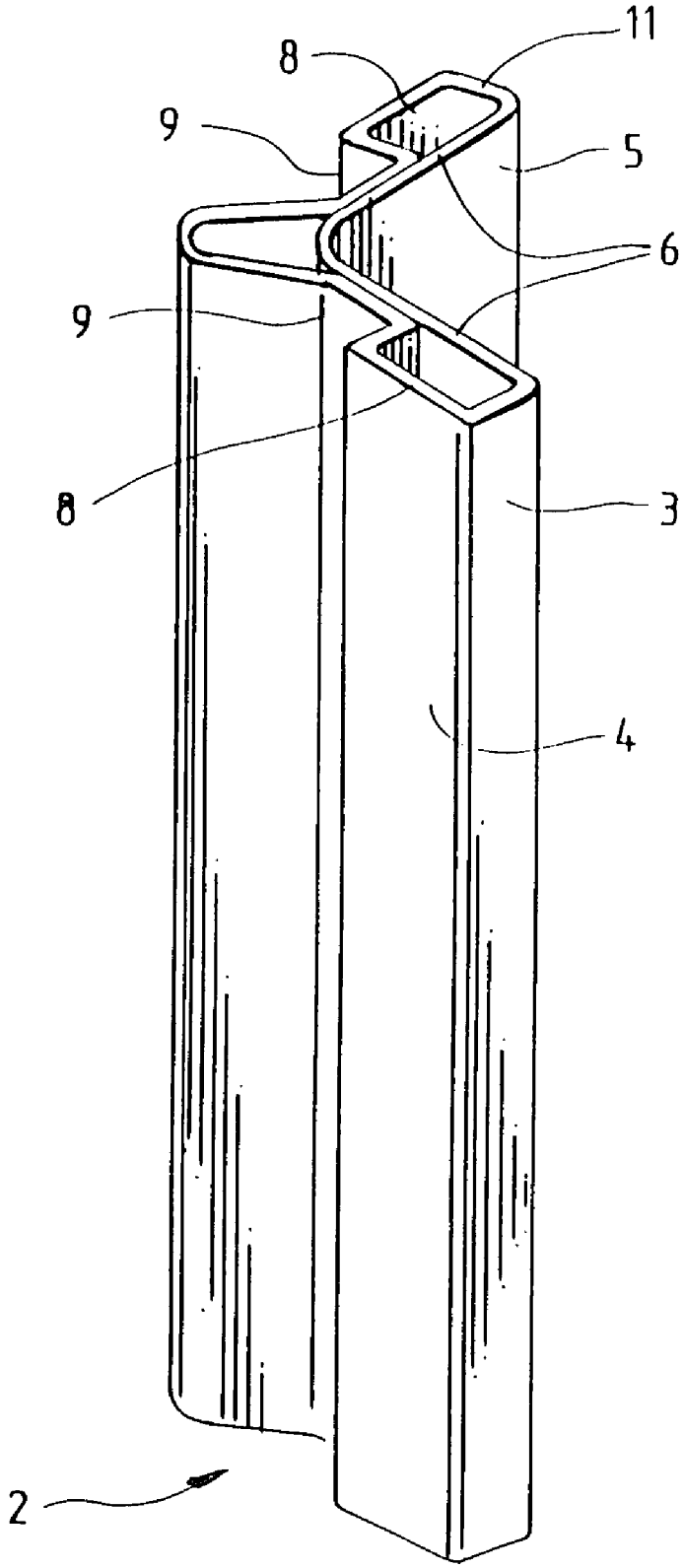
FIG. 1 PRIOR ART
FIG. 1 is a perspective view of a prior art corner post.

Turning to the drawings, there is shown in FIG. 1 a perspective view of a conventional tubular-type corner post 2. The corner post 2 normally extends from a base pad (not shown) located at the bottom of a product package to a top cap or lid (not shown). The corner post 2 protects and cushions the product from transverse (horizontal) forces during handling. In addition, the corner post helps support the package against axial (vertical) compressive forces, such as when packages are stacked.

Figure 2:
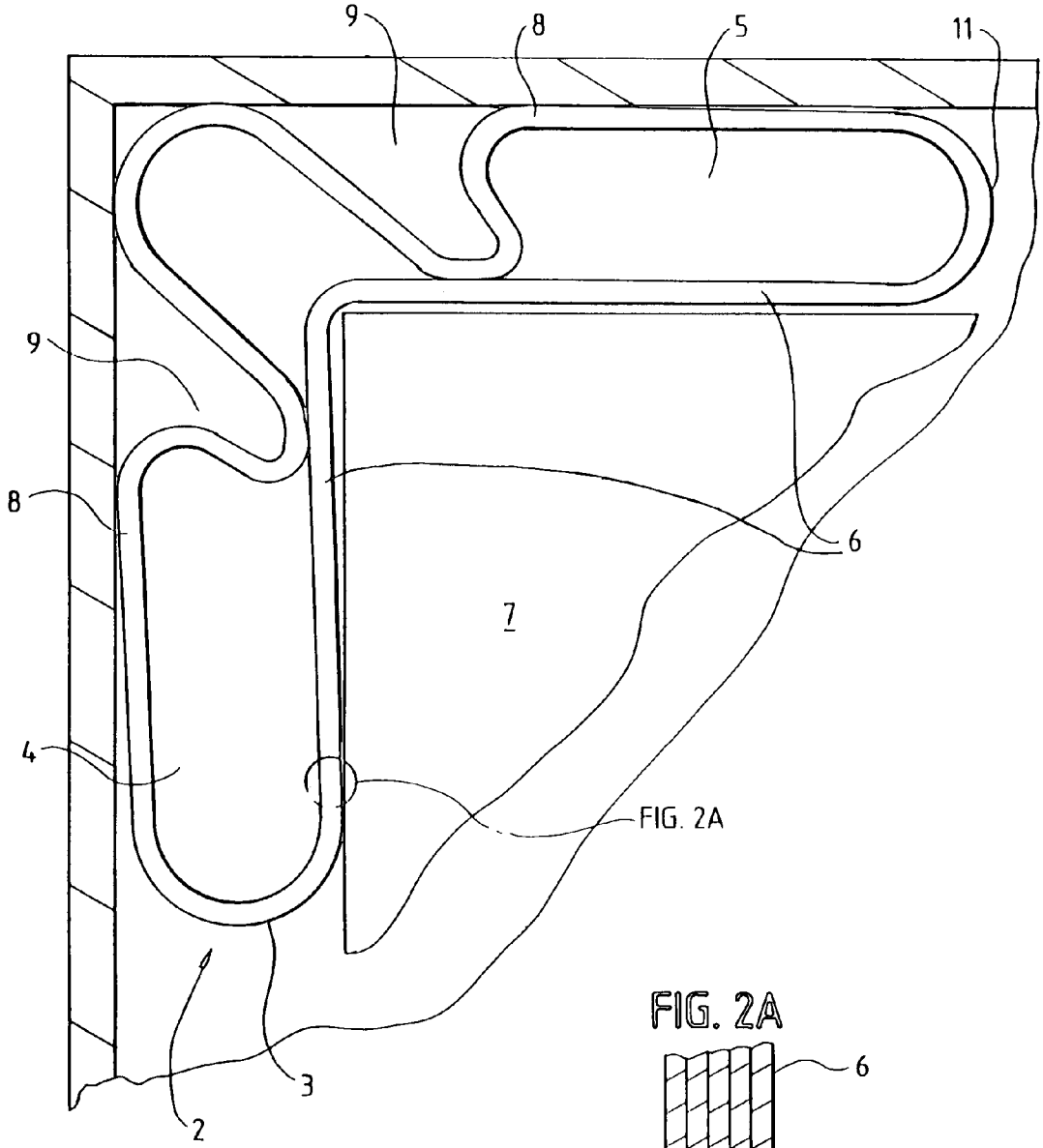
FIG. 2 PRIOR ART
FIG. 2 is a cross-sectional view of the prior art corner post of FIG. 1 partially enlarged to show the uniform paper layer configuration.

As best seen in the cross-sectional view of FIG. 2, the corner post comprises two legs 4, 5 substantially perpendicular to each other and terminating in rounded ends 3, 11. The legs 4, 5 are formed by an inner wall 6 (defined as the wall closest to the product 7) and an outer wall 8 (defined as the wall closest to the container sleeve 13) in generally parallel spaced relation to each other to form a hollow core.

Inwardly extending beads or grooves 9 may be formed in the outer wall 8 along each leg, at a point spaced from the rounded ends 3, 11. As best shown in FIG. 1, the beads 9 may extend the entire vertical length of the outer wall 8. The beads 9 may contact the inner wall 6, thus forming multiple enclosed areas within the corner post 2.

Corner posts may be used in the following manner. After manufacture, the product (typically a large appliance) is placed on and fastened to a pallet or base having dimensions greater than the width and depth of the appliance to accommodate corner posts. A protective sleeve typically made of paperboard or corrugated board is placed over the appliance to form the four sidewalls of the container. The sleeve fits inside the perimeter of the base. The corner posts are placed around the appliance between the appliance and the protective sleeve. A paperboard or corrugated top is placed over the package. Straps may be wrapped around the container to better secure the corner posts between the appliance and the container. The packaged appliances may be stacked on top of each other.

The corner post typically is formed of paper or paperboard convolutely wound into a tubular configuration and formed into a desired shape. As shown FIG. 2A, conventional corner posts are made of a single grade of paper. The single sheet is wound into a paper tube having multiple layers. For example, the corner post wall illustrated in FIG. 2A has five layers of wound paper.

Adhesive may be applied between the paper layers. Before the adhesive dries, the convolute tube is shaped into the desired cross-sectional shape. The corner post should be shaped to fit snugly between the corner of an appliance and the corners of the appliance container.

Figure 2A:
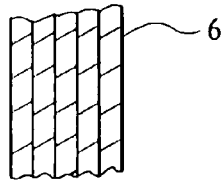

As shown in FIG. 2A, the outer facing layers and the plies that form the middle layer of the corner post wall are the same thickness.

In order to increase the stiffness, and thus the axial compression strength, of the post, it is desirable to form a corner post having a thicker middle layer interposed between the outer layers. We have developed a unique corner post comprising a base sheet of material wound into a hollow tube having outer facing layers and a middle layer interposed between the outer facing layers in which some or all of the middle layer is thicker than the outer layers.

In a first embodiment of the invention, the middle layer is made thicker by embossing. Embossed paper is a structured paper in which the paper sheet is purposely given a higher overall caliper (thickness), but the thickness is non-uniform. Embossed paper may be made by running a sheet of paper through a pair of opposing rollers, one or both having a variegated pattern, to create areas on the paper that are compressed and other areas where the paper fibers have been pushed upward to create raised areas. The embossed paper preferably has a nippled pattern, although any suitable pattern may be used in the present invention. The embossed pattern preferably is on one side of the paper only.

Figure 3:
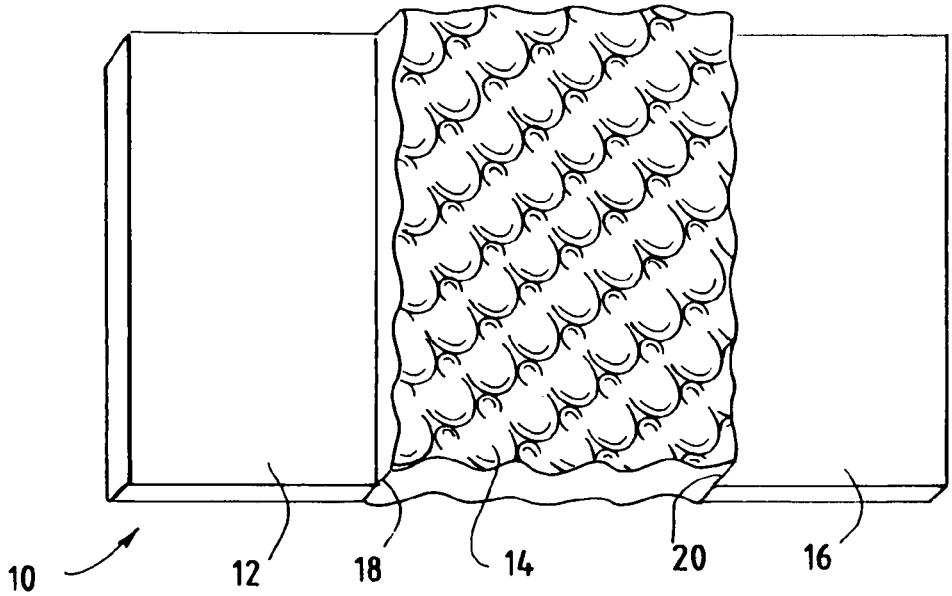
FIG. 3 is a perspective view of a base sheet used to form the corner post of the present invention, not drawn to scale.

As shown in FIG. 3, the base sheet 10 preferably is formed from a single continuous sheet in which only the portion 14 of the sheet that will form the middle layer of the post is embossed. Thus, in the cross-machine direction, the base sheet comprises a first non-embossed section 12, an embossed section 14, and a second non-embossed section 16.

Alternatively, the base sheet may be made by joining edge-to-edge in the cross-machine direction non-embossed and embossed sheets. The sheets may be joined to one another by adhesive, by taping them together with paper-backed tape, or by other suitable means. The edges of the sheets may be butt-joined, skive-joined or joined in any other suitable fashion.

Regardless of how the partially embossed base sheet 10 is formed, when the rectangular base sheet 10 is convolutely wound into a tube, the embossed section 14 becomes interposed between the non-embossed sections 12, 16 in the transverse direction.

Figure 4:
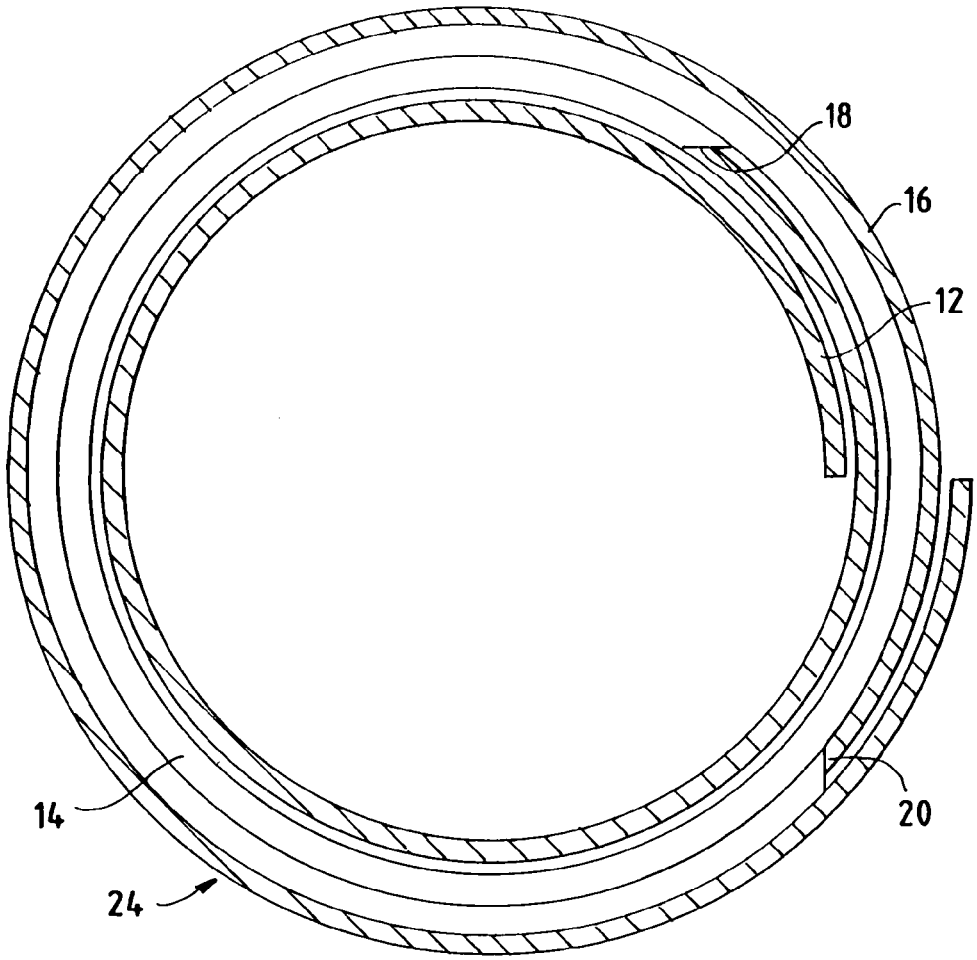
FIG. 4 is a top plan view of the base sheet of FIG. 3 shown loosely wound.

FIG. 4 shows the relative configuration of the sections 12, 14, 16 when loosely wound. The outer facing layer of the loosely wound tube 24 that faces the hollow interior of the tube is formed by the first non-embossed section 12, the outer facing layer of the loosely wound tube 24 that faces the exterior is formed by the second non-embossed section 16, and the interior, or middle layer of the tube 24 is formed by the thicker embossed section 14 of the base sheet 10.

After the base sheet 10 is wound into a tube (and before the adhesive applied between the paper layers is set), the tube 24 is formed on a mandrel into a corner post having a desired cross-sectional shape. An example of one such corner post 26 is provided in FIG. 5. Like the conventional corner post 2 of FIG. 2, the corner post 26 of FIG. 5 comprises two legs 28, 30 substantially perpendicular to each other which terminate in rounded ends 29, 31. The legs 28, 30 are formed by an inner wall 34 and an outer wall 36 with hollow spaces therebetween. Optional beads are formed in the outer wall 36 along each leg 28, 30 and extend the entire vertical length of the outer wall 36. The beads 38, 39 may contact the inner wall 34, thus forming multiple enclosed areas within the corner post 26.

Figure 5:
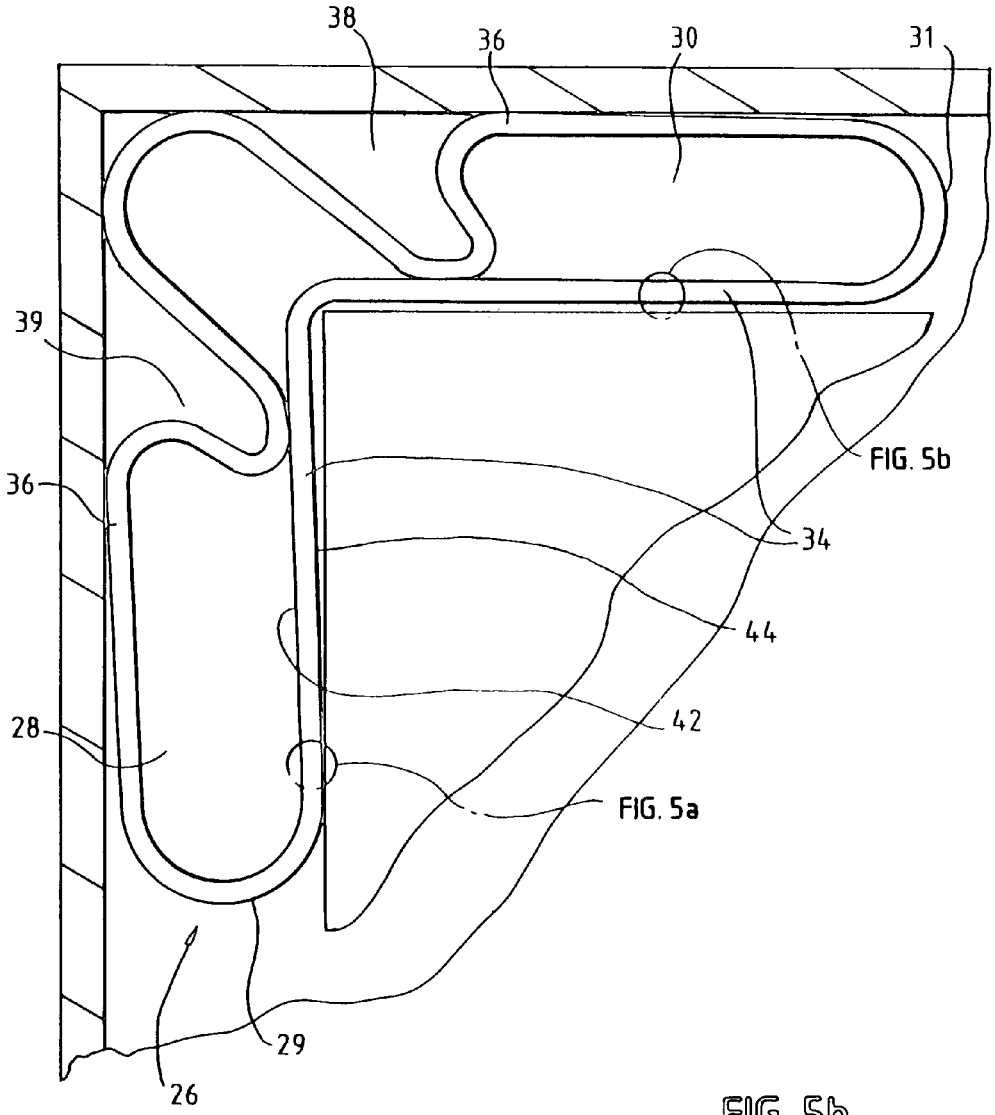
FIG. 5 is a cross-sectional view of a corner post made according to the present invention.
Figure 5A:
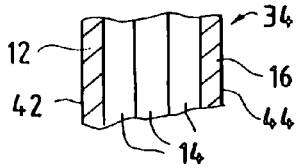
FIGS. 5*a* and 5*b* are partially enlarged views of the corner post wall of FIG. 5.
Figure 5B:
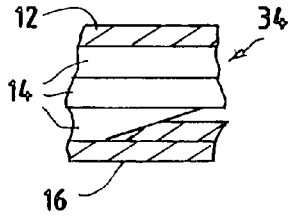

Unlike the corner post 2 of FIG. 2 which is formed from a sheet of material having a single thickness, the corner post of FIG. 5 is formed from a sheet of material having at least two different thicknesses. As best shown in enlargements 5*a* and 5*b*, the first non-embossed section 12 forms one outer facing surface 42 of the corner post 26, i.e., the surface facing the hollow interior. The second non-embossed section 16 forms another outer facing surface 44 of the corner post.

The thicker embossed section 14 is interposed between the first and second non-embossed sections and thus is not exposed except along the top and bottom of the corner post 26. The resulting corner post 26 has a thin-thick-thin configuration in the transverse direction.

To manufacture the corner post of FIG. 5, a base sheet of paper is fed from a roll to a cutting station where the sheet is cut to the desired vertical length. The cut sheet is run between embossing rollers which emboss selected sections of the sheet, creating a sheet having a thin-thick-thin caliper in the cross-machine direction. The remainder of the process is the same as that for making a conventional tubular type corner post.

Alternatively, two rolls of non-embossed paper and one roll of pre-embossed paper may be aligned edge to edge with the embossed roll located between the non-embossed rolls. As the paper comes off the rolls, the edges are skived, then the edges of the paper sheets are glued together using two small glue pots. The composite sheet is then cut into rectangular base sheets having the desired vertical length, i.e., the length of the finished corner post. The remainder of the process is the same as that for making a conventional tubular type corner post.

Figure 6:
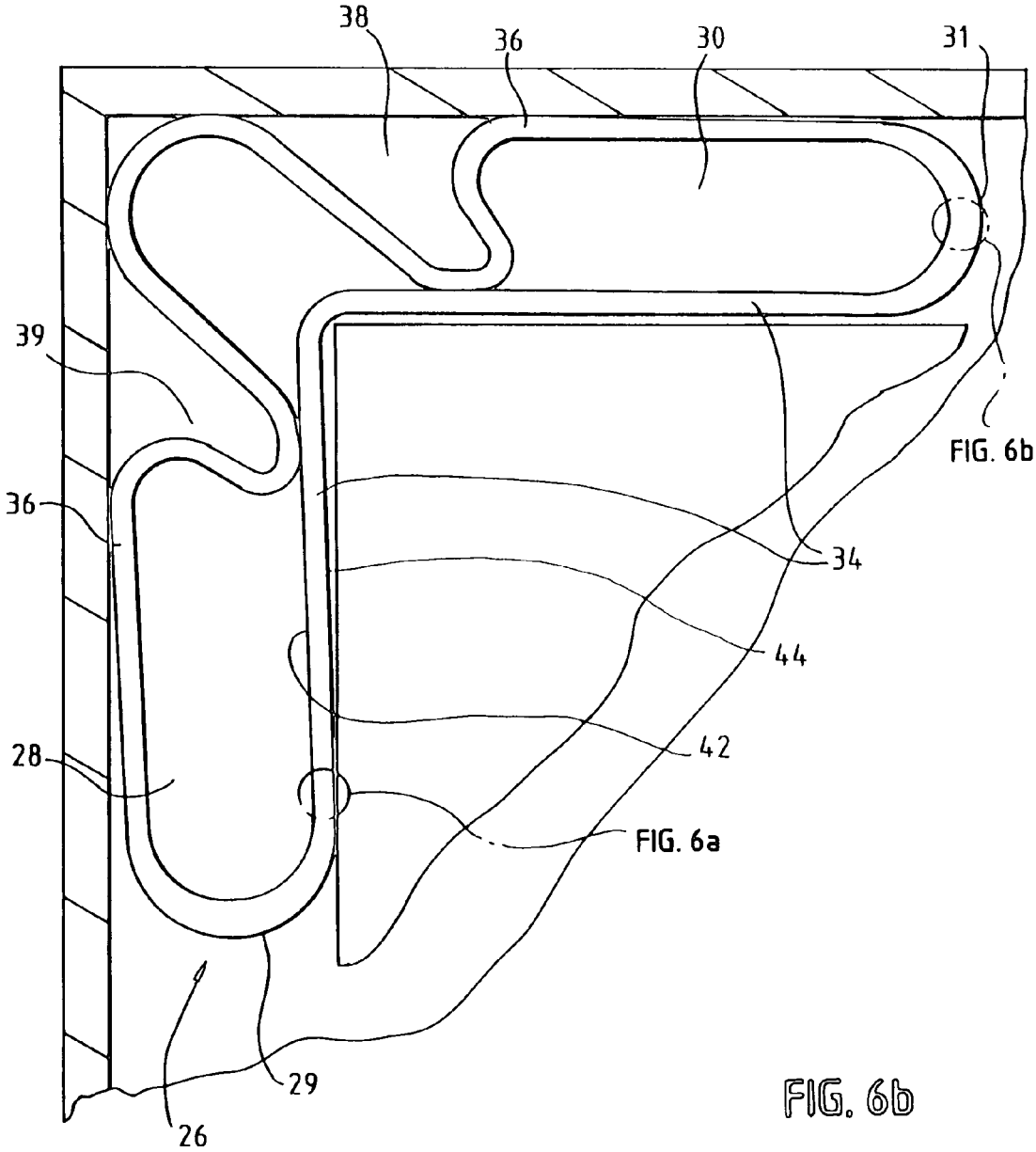
FIG. 6 is a cross-sectional view of another corner post made according to the present invention.
Figure 6A:
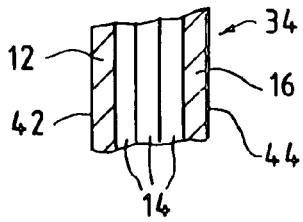
FIGS. 6*a* and 6*b* are partially enlarged views of the corner post wall of FIG. 6.
Figure 6B:
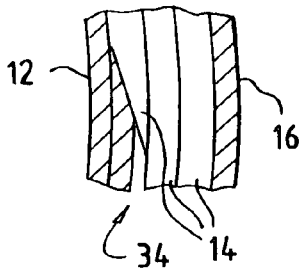

The corner post shown in FIG. 5 has a substantially uniform wall thickness, albeit one having a higher caliper than a conventional post made from the same amount of material. That is, the thickness of the post wall is substantially the same throughout. In one possible variation, the corner post of the present invention does not have a uniform wall thickness, but rather is thicker in some areas. For example, as shown in FIG. 6, it is possible to make thicker only the curved portions of the post such as the ends 29, 31 by embossing only those sections of paper that will form the middle layer 14 of the rounded ends 29, 31. Conversely, the straight wall portions can be made thicker than the curved portions.

Figure 7:
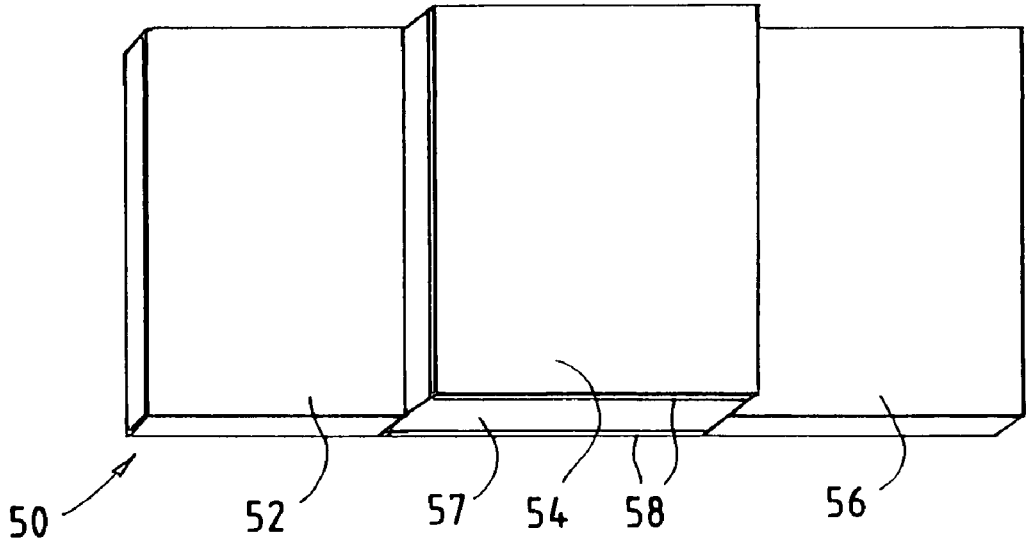
FIG. 7 is a perspective view of a base sheet used to form a second embodiment of the corner post of the present invention, not drawn to scale.

In a second embodiment of the invention, the base sheet 50 shown in FIG. 7 has a middle section 54 made of low density paper of increased caliper joined edge to edge with conventional or lower thickness paper 52, 56. The low density paper 54 may be made from recycled fiber to provide added bulk at a given weight. Preferably, the low density paper 54 has a low density middle portion 57 sandwiched between smooth surfaces (liners) 58 to provide a paper that may be laminated to adjacent sheets. The corner post is manufactured from the rectangular base sheet 50 in a manner similar to that already described.

Figure 8:
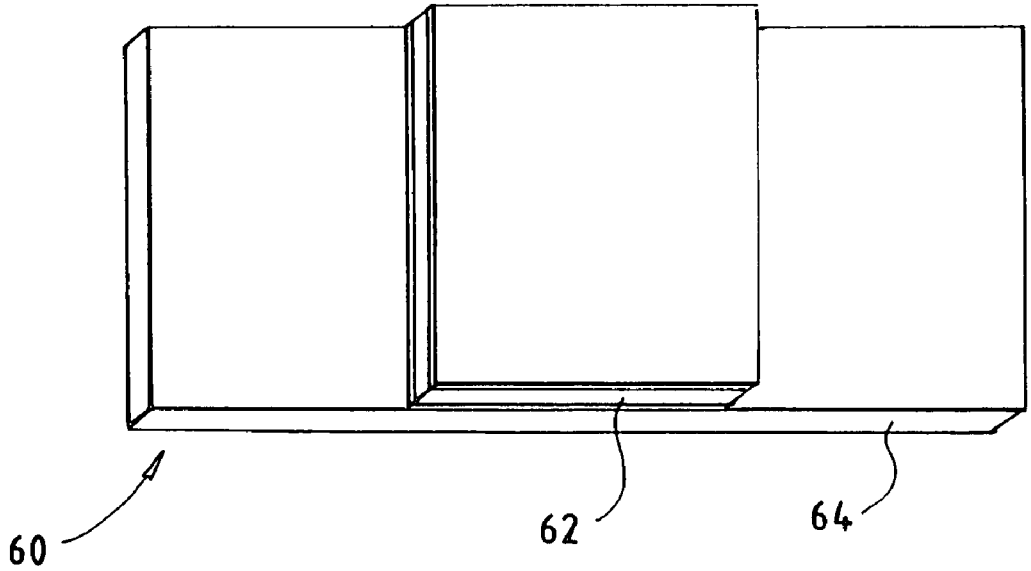
FIG. 8 is a perspective view of a base sheet used to form a third embodiment of the corner post of the present invention, not drawn to scale.

In a third embodiment of the invention, the post is formed from a combined sheet 60 shown in FIG. 8 comprising one or more second sheets 62 laminated or otherwise affixed to a substrate 64 in selected areas. The combined sheet 60 has alternating thicknesses in the cross machine direction. The second sheet 62 preferably is low density paper but may be embossed paper or any paper that has increased bulk at a given weight.

Figure 9:
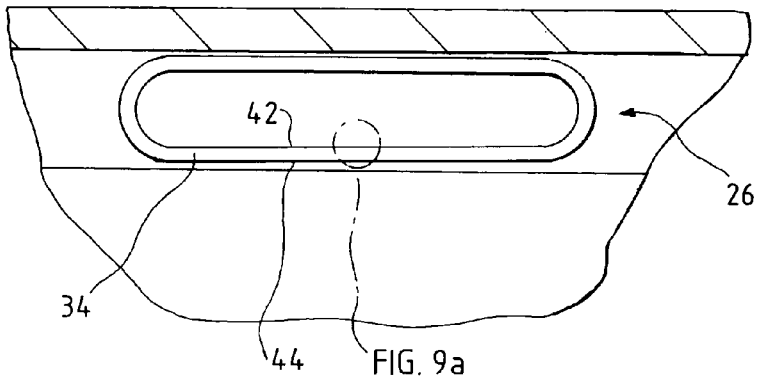
FIG. 9 is a cross-sectional view of another corner post made according to the present invention.
Figure 9A:
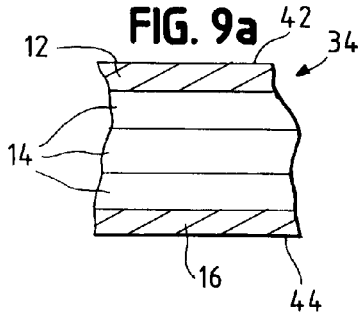
FIG. 9*a* is a partially enlarged view of the corner post of FIG. 9.
Figure 10:
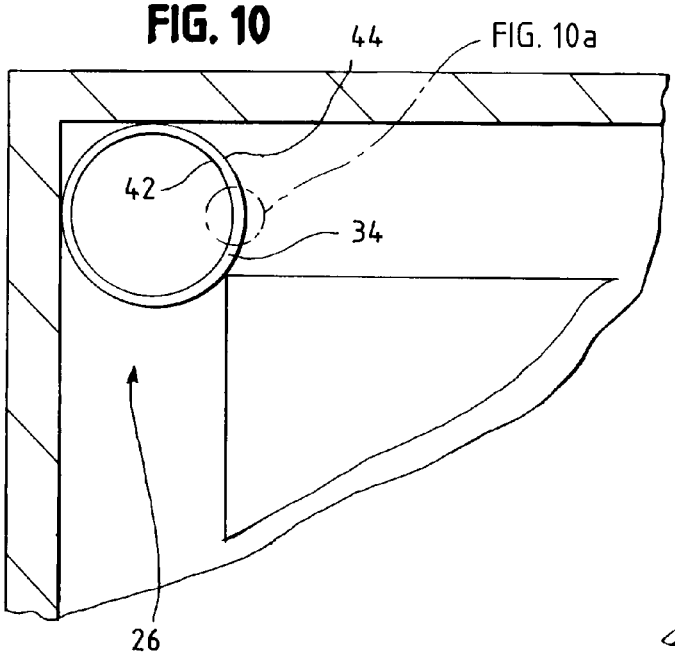
FIG. 10 is a cross-sectional view of another corner post made according to the present invention.
Figure 10A:
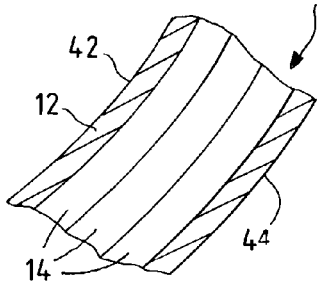
FIG. 10*a* is a partially enlarged view of the corner post of FIG. 10.

While the embodiments described above are all corner posts having a substantially L-shaped cross-sectional profile, it is to be understood that the post may assume other shapes, such as a side post having an I-shaped cross-sectional profile (FIGS. 9 and 9*a*) or a post having a triangular, round (FIGS. 10 and 10*a*) or angular cross-sectional profile. The side post, like the corner post, is made from a multiple-sheet blank wound into a tube and formed on a mandrel into a post having a desired cross-sectional shape. The side post would be used to support and cushion the sides of products.

Further modifications and alternative embodiments of the invention are contemplated which do not depart from the scope of the invention as defined by the foregoing teachings and appended claims. It is intended that the claims cover all such modifications that fall within their scope.

The invention claimed is:

1. An improved post for supporting and cushioning a product, the post comprising a base sheet convolutely wound into a hollow tube having two outer facing layers and a middle layer comprising one or more plies and interposed between the outer facing layers to form a post wall, the improvement comprising:

at least one of the plies that forms the middle layer being thicker in at least some areas than the outer facing layers.

2. The post of claim 1 wherein the middle layer comprises embossed paper.

3. The post of claim 2 wherein the embossed paper is dimpled.

4. The post of claim 2 wherein the embossed paper is embossed on one side only.

5. The post of claim 2 wherein the base sheet is a single continuous unitary sheet in which only that portion of the continuous sheet that forms the middle layer is embossed.

6. The post of claim 2 wherein the base sheet comprises non-embossed and embossed sheets joined edge to edge in the cross machine direction.

7. The post of claim 1 wherein the post wall has a uniform wall thickness.

8. The post of claim 1 wherein the post wall thickness varies.

9. The post of claim 8 wherein the post wall comprises straight portions and curved portions, and the curved portions are thicker than the straight portions.

10. The post of claim 1 wherein at least part of the middle layer is low density paper.

11. The post of claim 10 wherein the low density paper comprises recycled fiber.

12. The post of claim 11 wherein the low density paper comprises a low density middle portion sandwiched between smooth liners.

13. The post of claim 1 wherein the base sheet is formed by laminating one or more second sheets onto a substrate in selected areas such that the base sheet has alternating thicknesses in the cross machine direction.

14. The post of claim 13 wherein the second sheet is low density paper.

15. The post of claim 13 wherein the second sheet is embossed paper.

16. The post of claim 1 wherein the post has a substantially L-shaped cross-sectional profile.

17. The post of claim 1 wherein the post has a substantially I-shaped cross-sectional profile.

18. The post of claim 1 wherein the post has a substantially triangular cross-sectional profile.

19. The post of claim 1 wherein the post has a substantially round cross-sectional profile.

20. The post of claim 1 wherein the post has a substantially angular cross-sectional profile.

* * * * *